US011294322B2

(12) United States Patent
Cohen et al.

(10) Patent No.: US 11,294,322 B2
(45) Date of Patent: Apr. 5, 2022

(54) CLEANING OF PRINT APPARATUS COMPONENTS WITH ROTATION AND OSCILLATION

(71) Applicant: Hewlett-Packard Development Company, L.P., Spring, TX (US)

(72) Inventors: Lavi Cohen, Ness Ziona (IL); Michael Vinokur, Ness Ziona (IL); Asaf Shoshani, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/261,518

(22) PCT Filed: Sep. 17, 2018

(86) PCT No.: PCT/US2018/051340
§ 371 (c)(1),
(2) Date: Jan. 19, 2021

(87) PCT Pub. No.: WO2020/060530
PCT Pub. Date: Mar. 26, 2020

(65) Prior Publication Data

US 2021/0341871 A1 Nov. 4, 2021

(51) Int. Cl.
*G03G 21/00* (2006.01)

(52) U.S. Cl.
CPC ..... *G03G 21/0058* (2013.01)

(58) Field of Classification Search
CPC ..... G03G 21/0058
USPC ..... 399/357
See application file for complete search history.

(56) References Cited

U.S. PATENT DOCUMENTS

| | | | | | |
|---|---|---|---|---|---|
| 3,740,789 | A * | 6/1973 | Ticknor | G03G 21/0029 | 399/351 |
| 3,854,814 | A * | 12/1974 | Jones | G03G 21/0029 | 399/350 |
| 3,947,108 | A * | 3/1976 | Thettu et al. | G03G 21/0005 | 399/347 |
| 4,982,239 | A * | 1/1991 | Kume et al. | G03G 21/0058 | 399/349 |
| 6,334,042 | B1 * | 12/2001 | Quesnel | G03G 21/0035 | 399/357 |
| 7,756,461 | B2 | 7/2010 | Sato | | |
| 8,494,404 | B2 | 7/2013 | Takagi et al. | | |
| 2004/0144618 | A1 | 7/2004 | McDonald et al. | | |
| 2014/0144469 | A1 | 5/2014 | Egan | | |

(Continued)

FOREIGN PATENT DOCUMENTS

| | | | |
|---|---|---|---|
| DE | 102006035988 | B4 | 5/2008 |
| JP | H0683165 | A | 3/1994 |
| JP | H0876639 | A | 3/1996 |

(Continued)

*Primary Examiner* — William J Royer
(74) *Attorney, Agent, or Firm* — HP Inc. Patent Department

(57) ABSTRACT

A print apparatus component to be cleaned is rotated about a rotational axis. A cleaning element having a cleaning surface in contact with the print apparatus component is rotated. The cleaning element is oscillated in a direction parallel to the rotational axis. Rotation and oscillation of the cleaning element are varied according to a predetermined function to remove a residue from the print apparatus component.

14 Claims, 5 Drawing Sheets

(56) References Cited

U.S. PATENT DOCUMENTS

2015/0090142 A1 4/2015 Roberts et al.

FOREIGN PATENT DOCUMENTS

| | | | |
|---|---|---|---|
| JP | H1063157 | A | 3/1998 |
| JP | 2007293040 | A | 11/2007 |
| JP | 2010085689 | A | 4/2010 |
| JP | 2012133001 | A | 7/2012 |

* cited by examiner

CLEANING OF PRINT APPARATUS COMPONENTS WITH ROTATION AND OSCILLATION

BACKGROUND

A print apparatus may apply print agents to a paper or another substrate. In one example, a print apparatus may apply a print agent that is an electrostatic printing fluid (e.g., electrostatically chargeable toner or resin colorant particles dispersed or suspended in a carrier fluid). Such a system is commonly referred to as a LEP printing system. In other examples, a print apparatus may apply a print agent via a dry toner or an inkjet printing technology.

DRAWINGS

DETAILED DESCRIPTION

Figure 1:
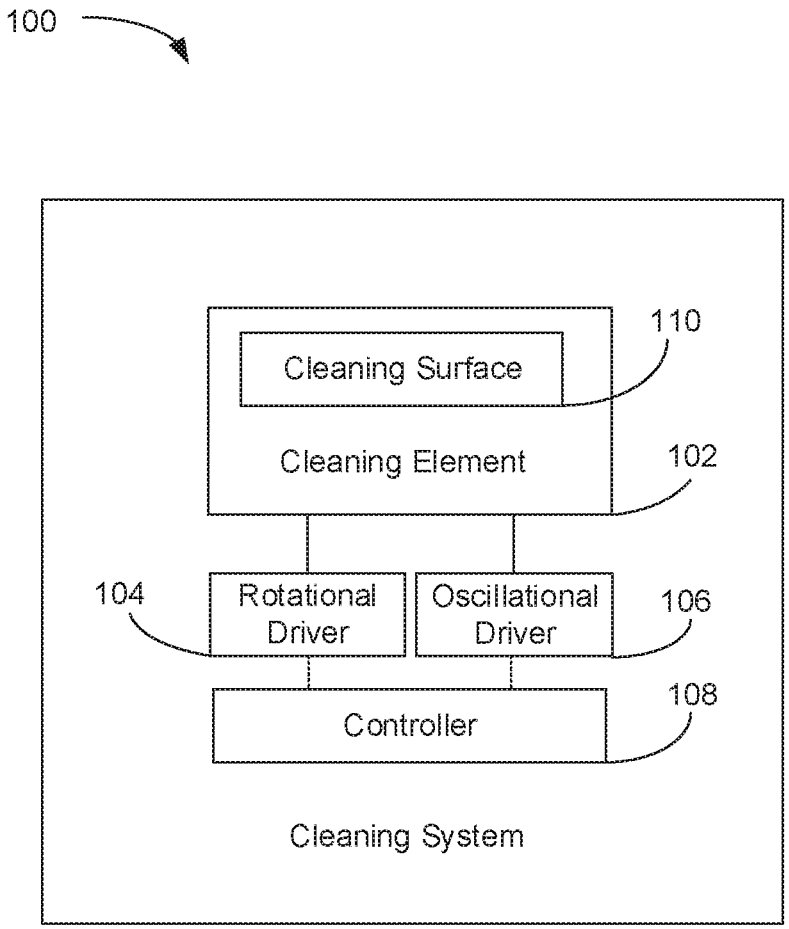
FIG. 1 is a block diagram depicting an example of a system for cleaning a print apparatus component.

A LEP print apparatus includes various components that are to receive a print agent. The print apparatus components may be periodically cleaned to remove residue that would otherwise negatively affect the quality of printed images. However, with certain printing applications, the extent and nature of residue has been such that conventional cleaning methods and systems have not been consistently effective to remove the residue. For instance, a LEP print system may include a print apparatus component (e.g., an amorphous silicon ("aSi") drum with a photoconductive surface, or a roller in a developer unit) that is susceptible to a build-up of an oxidized imaging oil residue. The oxidized imaging oil residue may be chemically attached to the surface of the print apparatus component, and thereby be difficult to remove. If not removed from the print apparatus component, the residue can cause an unwanted pattern to appear in printed images and thereby significantly affect print quality. In examples, the unwanted pattern may be manifested as a dot area, a streak, or any other errant pattern resulting from pixels on a surface of the print apparatus component not functioning as they should. Further, the accumulation of imaging oil residue can shorten the working life of the affected print apparatus component, requiring frequent replacements and increasing printing costs.

To address these issues, various examples described in more detail below provide a system and a method for cleaning a print apparatus component. In an example of the disclosed method, a print apparatus component to be cleaned is rotated about a rotational axis. A cleaning element, having a cleaning surface in contact with the print apparatus component is rotated. The cleaning element is oscillated in a direction parallel to the rotational axis. The rotation and the oscillation of the cleaning element is varied according to a predetermined function to remove a residue from the print apparatus component.

In an example of the disclosed cleaning system, the system includes a cleaning element having an abrasive cleaning surface. The cleaning element is to contact a print apparatus component that rotates about a first rotational axis. The system includes a rotational driver to cause the cleaning element to rotate about a second rotational axis that is parallel to the first rotational axis. The cleaning system includes an oscillational driver to cause the cleaning element to oscillate in an oscillation direction parallel to the first rotational axis. The cleaning system includes a controller to cause the oscillational driver and the rotational driver to move the cleaning element to remove a residue from the print apparatus component.

In this manner the disclosed method and system provides for effective and efficient removal of residues from a print apparatus component. In particular examples, the disclosed method and system enable use of an abrasive surface to clean oxidized print agent from a photoconductive surface in single drum cycle without negatively affecting performance of the photoconductive surface. Users and providers of LEP printer systems and other printer systems will appreciate the improvements in print quality, the reductions in print apparatus downtime, and the prolonged replacement periods and consumables lifespans that are afforded by utilization of the disclosed examples. Installations and utilization of LEP printers that include the disclosed method and system should thereby be enhanced.

FIG. 1 illustrates an example of a cleaning system 100 for cleaning a print apparatus component. In this example, cleaning system 100 includes a cleaning element 102, a rotational driver 104, an oscillational driver 106, and a controller 108. In performing its functions, controller 108 may access a data repository, e.g., a memory accessible to cleaning system 100 that can be used to store and retrieve data.

In the example cleaning system 100 of FIG. 1, the cleaning element 102 is to contact a print apparatus component that is rotating about a first rotational axis. In an example, the rotating print apparatus component to be cleaned may be a photoconductor. As used herein, "photoconductor" refers generally to a material or a device that becomes more electrically conductive as it is exposed to electromagnetic radiation (e.g., visible light, ultraviolet light, infrared light, or gamma radiation). In an example, the rotating print apparatus component to be cleaned may be a photoconductive cylinder, e.g., a rotating drum with a photoconductive surface. As used herein, "photoconductive" refers generally to a material or a device having a property of becoming more electrically conductive as it is exposed to electromagnetic radiation. In a particular example the drum may be a drum that includes multiple layers, with the outermost layer being a photoconductive surface. In another particular example, the drum may have a consumable outermost photoconductive layer. In yet another example, the drum may be an amorphous silicon ("aSi") drum with a photoconductive outermost layer.

Continuing with the example of FIG. 1, In an example of LEP printing, the photoconductor or photoconductive surface that is to be cleaned by cleaning system 100 may be a photoconductive element upon which the LEP printer system places an electrostatic charge during a printing operation. The LEP printer system may place the electrostatic charge utilizing a laser scanning unit, LED, or other light source to apply an electrostatic pattern, in the form of an image that is to be printed by the LEP printer system, on the photoconductive element. The application of the electrostatic pattern is to selectively discharge the photoconductive element. The selective discharging forms an electrostatic latent image on the photoconductive element.

In another example the rotating print apparatus component to be cleaned by cleaning system 100 may be a developer roller, or other roller, of a developer unit used in LEP printing. As used herein, "developer unit" refers generally to an apparatus that prepares a thin film of electrically charged ink and carrier fluid to a development roller surface. As used herein, "developer roller" refers generally to a roller of the developer unit that directly engages with the photoconductor to apply, through a combination of electrical and mechanical forces, a charged print agent to the photoconductor. In an example, the combination of electrical fields applied to the photoconductor and within the developer unit result in attracting an ink paste to image areas of the photoconductor, and repelling ink paste from non-image areas. The result is replication of the electrostatic latent image that was formed upon the photoconductor with an inked image. As used herein, an "ink" refers generally to any fluid that is to be applied to a substrate during a printing operation to form an image upon the substrate. In examples inks may be, or include, aqueous inks, solvent inks, UV-curable inks, dye sublimation inks, latex inks, liquid electrophotographic inks, liquid or solid toners, or powders. As used herein, the term "print agent" refers generally to any material to any substance that can be applied upon a media by a printer during a printing operation, including but not limited to inks, primers, and overprint materials (such as a varnish).

In certain examples, the photoconductor may engage with an intermediate transfer member (e.g., a blanket), which intermediate transfer member in turn engages with a substrate to convey the developed (sometimes referred to as "inked") image to the substrate to form a printed image. In other examples, the photoconductor may engage directly with a substrate to form a printed image.

In certain examples, the photoconductor may be attached to a rotatably mounted drum and the blanket may be attached to another rotatably mounted drum, wherein the drums are arranged such that the photoconductor and the blanket each are to rotate about one another during the rotations.

Continuing with the example of FIG. 1, in examples, the print apparatus component that is to be cleaned by cleaning system 100 is a component that has been coated with imaging oil. As used herein, "imaging oil" refers generally to an oil that is utilized in LEP printing to act on a carrier fluid for ink particles and/or as a lubricant for certain print apparatus components that contact one another. In an example, the print apparatus component to be cleaned by cleaning system 100 may be a photoconductor, e.g., a photoconductive surface of a rotatable drum, that has had imaging oil applied to it by a developer unit. In another example, the print apparatus component to be cleaned by cleaning system 100 may be a developer roller of a developer unit that has had imaging oil applied to it by a developer unit.

Cleaning system 100 includes the rotational driver 104 to cause cleaning element 102 to rotate about a second rotational axis parallel to the first rotational axis of the print apparatus component. As used herein a "rotational driver" refers generally to any combination of hardware to cause a cleaning element to rotate about an axis. In an example, the rotational driver may include one or all of a set of gears, a set of pulleys, a transmission, and/or a motor.

Continuing with the example of FIG. 1, cleaning system 100 includes the oscillational driver 106 to cause cleaning element 102 to oscillate in an oscillation direction parallel to the first rotational axis of the print apparatus component. As used herein an "oscillational driver" refers generally to any combination of hardware to cause a cleaning element to oscillate. In an example, the oscillational driver may include one or all of a set of gears, a set of pulleys, a transmission, a piston, a cam, a crankshaft, and/or a motor.

Cleaning system 100 includes the controller 108 to control movement of rotational driver 104 and movement of oscillational driver 106 to cause cleaning element 102 to remove a residue from the print apparatus component. As used herein, "residue" refers generally to any contaminant or other substance that remains on the print apparatus component to be cleaned after the print apparatus component has been used in a printing operation. In varying examples, the residue may include leftover print agent (e.g., leftover ink, primer or overcoat), or even paper dust. In a particular example, the residue to be removed may be oxidized print agent that accumulated at a print apparatus component (e.g., a photoconductor or a developer roller) during a LEP printing process (e.g., imaging oil and/or ink) at the print apparatus component.

Continuing with the example of FIG. 1, controller 108 may cause rotational driver 104 and oscillational driver 106 to vary rotation and oscillation of cleaning element 102 according to a predetermined function. In certain examples, the predetermined function is to consider as a variable an extent of residue detected at the print apparatus component. In examples, the predetermined function will cause rotational driver 104 and oscillational driver 106 to move cleaning element 102 in a manner that increases oscillation action relative to rotation action as the amount of detected residue increases.

Continuing with the example of FIG. 1, various systems for detecting extent of accumulated residue at a print apparatus component may be used. In one example, extent of residue at the print apparatus component may be detected via analysis of an image printed that was by a printing system that includes the print apparatus component. In examples, detected patterns and amounts of print quality defects in a printed image can be compared with a baseline pattern or amount or target patterns or amounts (e.g., via a look up table) to identify levels of residue at a print apparatus component. In examples, such detection and identification of streak patterns in a printed image may be performed by utilizing a spectrophotometer or other camera system.

In examples, cleaning system 100 may include a sensor that is to measure reflectance at the surface of the print apparatus component, with different reflectances being indicative of levels of residue at the print apparatus component. In examples, a detected reflectance can be compared with a baseline reflectance or target reflectances (e.g., via a look up table) to identify levels of residue that have accumulated at a print apparatus component. In examples, the sensor utilized to measure reflectance at the print apparatus component may be an optical sensor.

Continuing with the example of FIG. 1, in an example where the print apparatus component is a photoconductor, cleaning system 100 may include an apparatus for measuring an electric current between the photoconductor and a developer unit that is for applying an ink paste coating upon the photoconductor. In this particular example, levels of electric current as between the photoconductor and the developer unit can be indicative of levels of residue present at the photoconductor.

In another example, controller 108 may apply a predetermined function that considers as a variable an extent of wear detected at the cleaning surface 110 of cleaning element 102. In this example, controller 108 may apply the predetermined function to cause rotational driver 104 and oscillational driver 106 to move cleaning element 102 in a manner that decreases oscillation action relative to rotation action as amount of detected wear increases. In an example, controller 108 is to cause oscillational driver 106 to decrease engagement relative to rotational driver 104 engagement responsive to receipt of data indicative that a thickness (e.g., a thickness of cleaning surface 110) of cleaning element 102 has degraded to less than a predetermined tolerance. In this manner the rate of wear upon the cleaning surface 110, and time to replacement, can be decreased.

Continuing with the example of FIG. 1, in another example controller 108 may cause oscillational driver 106 to increase engagement relative to rotational driver 104 engagement in response to controller 108 having received an instruction for deep cleaning of the print apparatus component. To accomplish the deep cleaning, controller 108 emphasizes the scrubbing benefits of the oscillation of cleaning element 102 over the decreased wear on cleaning surface 110 benefits that are afforded when rotational driver 104 is causing rotational movement of cleaning element 102.

In an example, the instruction received by controller 108 may be a user instruction initiated by a user via a graphic user interface at a printing apparatus, or at a computing system in network connection with the printing apparatus. In another example, the instruction received by controller 108 may be an instruction generated by a system at a printing apparatus other than cleaning system 100. For instance, controller 108 may receive an instruction for deep cleaning from a print quality system that analyzes printed images for streaking caused by a print apparatus component (e.g., a photoconductor or a developer roller).

In another example, controller 108 may receive an instruction for deep cleaning from a reflectance measurement system that measures reflectance at the surface of a photoconductor, the reflectance measurement system having determined that a deep cleaning is appropriate in view of perceived residue at the print apparatus component. In another example, controller 108 may receive an instruction for deep cleaning from a system that measures electric current between a photoconductor and a developer unit at a printing apparatus, the system having determined that an untenable amount of residue is present at the print apparatus component and that a deep cleaning is appropriate to remove such residue.

Figure 2:
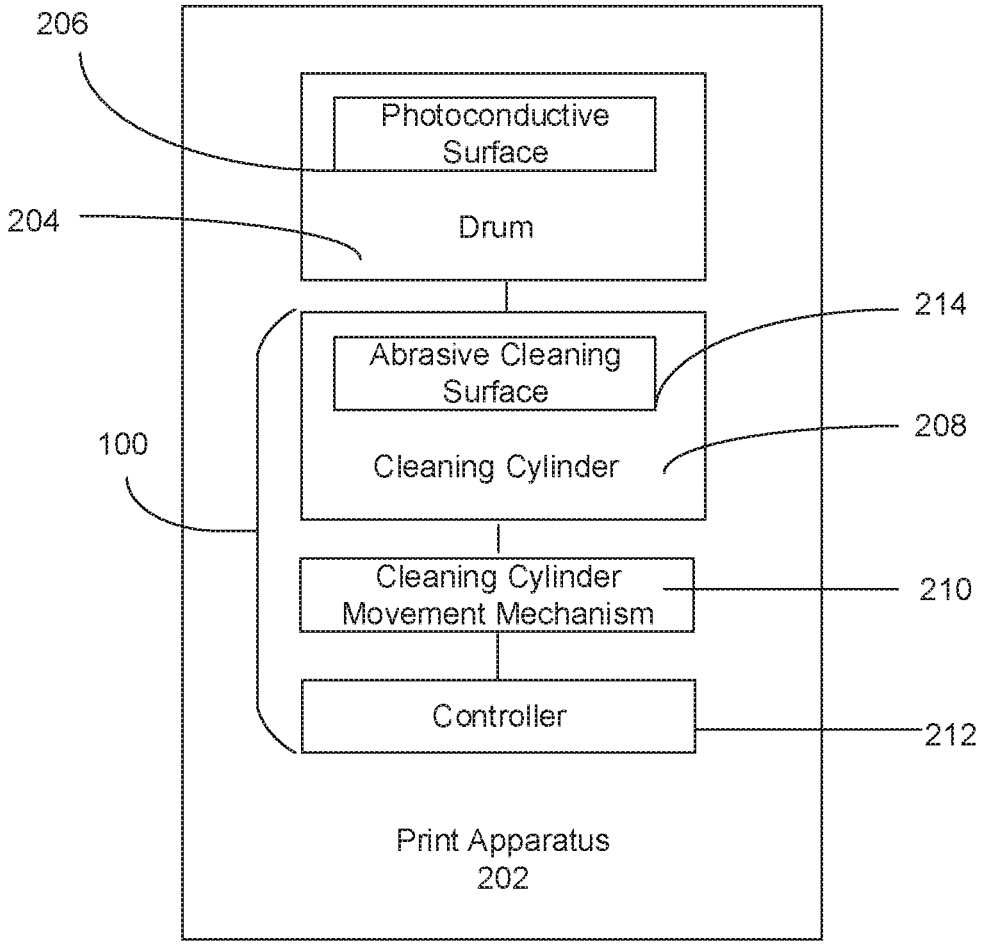
FIG. 2 is block diagram depicting an example of a print apparatus including a drum, a cleaning cylinder, a movement mechanism, and a controller for cleaning a photoconductive surface of the drum.

FIG. 2 illustrates an example of a print apparatus 202 that includes cleaning system 100 for cleaning of a print apparatus component. In this example, print apparatus 202 includes a drum 204 that is mounted upon a drum axle such that the drum 204 can rotate along a first rotational axis. Drum 204 includes a photoconductive surface 206. In a particular example, the drum 204 may be an aSi drum with the photoconductive surface. In yet other examples, rotatable drum 204 may be a rotatable aluminum or steel drum with a photoconductive surface 206 physically adhered (e.g., adhered via a fastener or a glue) to a curved surface of drum 204.

The cleaning system 100 at print apparatus 202 includes a cleaning element that is a cleaning cylinder 208, a cleaning cylinder movement mechanism 210, and a controller 212. In an example, cleaning cylinder 208 may be mounted on a cylinder axle to rotate about a second rotational axis parallel to the first rotational axis upon which the drum 204 to be cleaned is to rotate. In this example, cleaning cylinder 208 includes an abrasive cleaning surface 214 that is to contact the photoconductive surface 206 of the drum 204. In a particular example, abrasive cleaning surface 214 of cleaning cylinder 208 may be a hard surface (e.g., a surface including one or more of alumina particles or calcium carbide particles) disposed on an outer surface of an absorbent foam substrate. Cleaning cylinder 208 is to be positioned such that at least part of abrasive cleaning surface 214 engages photoconductive surface 206.

Continuing with the example of FIG. 2, the cleaning cylinder movement mechanism 210 is a combination of hardware and/or programming that is to cause cleaning cylinder 208 to rotate about the second rotational axis, and that is to cause cleaning cylinder 208 to oscillate in an oscillation direction that is parallel to the first rotational axis. In examples, cleaning cylinder movement mechanism 210 may include one or all of a set of gears, a set of pulleys, a transmission, and/or a motor to accomplish the rotational movement and the oscillation movements that cleaning cylinder 208 are to make.

Controller 212 is a combination of hardware and programming that is to control cleaning cylinder movement mechanism 210 such that oscillation of cleaning cylinder 208 in the oscillation direction, and rotation of cleaning cylinder 208 about the second rotational axis, are varied. In examples, hardware of controller 212 may include one or both of a processor and a memory, while the programming may be code stored on that memory and executable by the processor to perform the designated function. In an example, controller 212 may receive data indicative of a degree of residue accumulation at photoconductive surface 206, and dynamically vary the oscillation and the rotation of cleaning cylinder 208 in response to the received data.

Figure 3:
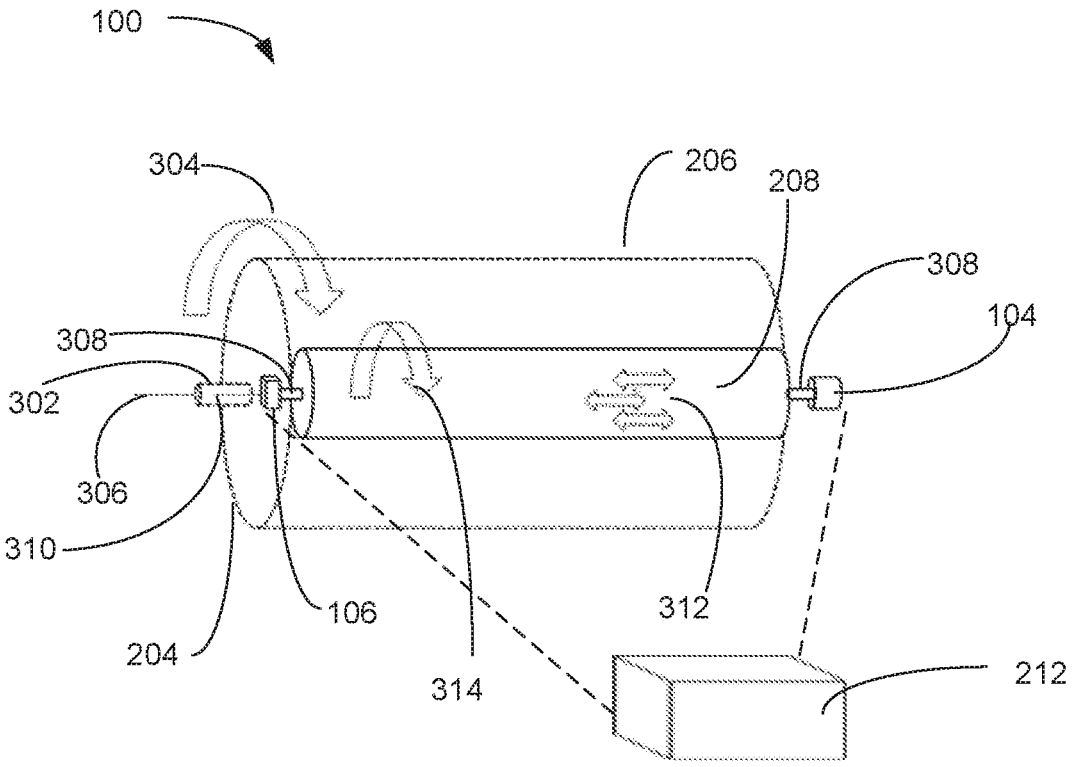
FIG. 3 is a simple schematic diagram that illustrates an example of a system for cleaning a print apparatus component.

FIG. 3 is a simple schematic diagram that illustrates an example of a system for cleaning a print apparatus component. In this example, cleaning system 100 includes a cleaning element that is a cleaning cylinder 208, a cleaning cylinder movement mechanism having a rotational driver 104 and an oscillational driver 106, and a controller 212. Drum 204 is a print apparatus component mounted on a drum axle 302 to rotate 304 along a first rotational axis 306 and has a photoconductive surface 206. Cleaning system 100 is for cleaning photoconductive surface 206 of drum 204.

Cleaning cylinder 208 is mounted on a cylinder axle 308 to rotate along a second rotational axis 310 that is parallel to first rotational axis 306. Cleaning system 100 has a cleaning cylinder movement mechanism that includes the rotational driver 104 to cause the cleaning cylinder 208 to rotate 314 about the second rotational axis 310, and the oscillational driver 106 to cause the cleaning cylinder 208 to oscillate in an oscillation direction 312 that is parallel to first the rotational axis 306.

Continuing with the example of FIG. 3, controller 212 is a combination of hardware and programming for varying the oscillation of cleaning cylinder 208 in oscillation direction 312 and the rotation 314 of cleaning cylinder 208 about second rotational axis 310. Controller 212 is to receive, e.g., from a subsystem at a printing apparatus or via user input, data indicative of a degree of residue at photoconductive surface 206. Controller 212 is to vary the oscillatory and rotational movements of cleaning cylinder 208 responsive to the amount of residue indicated by the received data.

Figure 4:
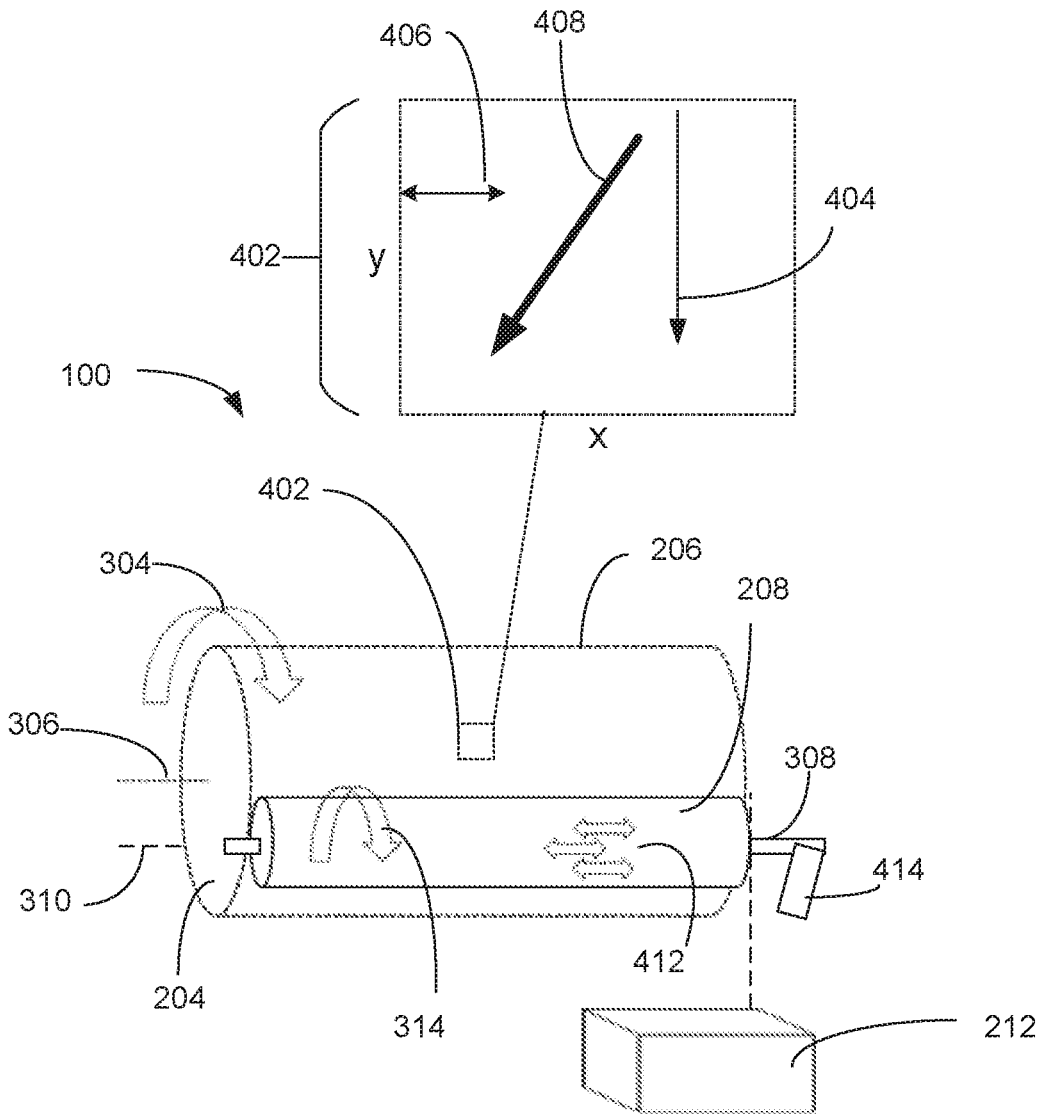
FIG. 4 is a simple schematic diagram that illustrates an example of a system for cleaning a print apparatus component causing residue removal with a varying diagonal wiping line.

FIG. 4 is a simple schematic diagram that illustrates an example of a cleaning system 100 for cleaning a print apparatus component causing residue removal with a varying diagonal wiping line. In this example a drum 204 is situated for rotating about a first rotational axis 306. Drum 204 has, or has attached, a photoconductive surface 206. Cleaning system 100 includes a cleaning element that is a cleaning cylinder 208 situated upon a cylinder axle 308. Cleaning cylinder 208 is to rotate along a second rotational axis 310 parallel to first rotational axis 306 and is for cleaning photoconductive surface 206 of drum 204.

The hashed square depicted at the photoconductive surface 206 of drum 204 is an example of a cleaned portion 402 arbitrarily selected to illustrate how rotation of the cleaning cylinder 208 and the oscillation of cleaning cylinder 208 relative to the rotation of the drum 204 can cause the cleaning cylinder 208 to remove residue from the photoconductive surface 206 with a diagonal wiping line relative to the direction of rotation of the drum 204. Controller 212 is to cause the cleaning cylinder 208 to concurrently rotate around second rotational axis 310 and to oscillate in an oscillation direction 412. A rotation motion 314 of cleaning cylinder 208 if caused by controller 212 to occur by itself would result in a first wiping line 404 that is orthogonal to first rotational axis 306 and second rotational axis 310. An oscillation motion 412 of cleaning cylinder 208, if caused by controller 212 to occur by itself, would result in a second wiping line 406 that is parallel to first rotational axis 306 and second rotational axis 310. In this example, controller 212 is to cause cleaning cylinder 208 to be moved with the rotation motion 314 concurrent with being moved with the oscillation motion 412. This concurrent rotational and oscillational movement is to cause cleaning cylinder 208 to remove residue from photoconductive surface 206 with a resulting diagonal wiping line 408. Because of the oscillation, and the control on the velocities, the wiping direction is changing to cause a more uniform cleaning of photoconductive surface 206. Print quality defects such as streaks that might otherwise occur as a result of residue at the photoconductive surface 206 can thus be greatly reduced, or in some cases, eliminated.

In an example, controller 212 may cause changes in the rotational speed of cleaning cylinder 208 to cause variances in an angle of diagonal wiping line 408. In another example, controller 212 may cause changes in the oscillation speed of cleaning cylinder 208 to cause the angle of diagonal wiping line 408 to be changed. In another example, controller 212 may cause changes in the speed of rotation of drum 204 to cause the angle of diagonal wiping line 408 to be changed. In a particular example, cleaning system 100 may include a biasing element 414 for applying a controlled pressure (e.g., a deflection pressure or force) between cleaning cylinder 208 and drum 204. In this particular example, controller 212 may cause changes in the controlled pressure between drum 204 and cleaning cylinder 208 to cause the angle of diagonal wiping line 408 to be changed. In examples, biasing element 414 may include one or more of a compression spring, an extension spring, or a torsion spring for providing such controlled pressure.

In each of the examples set forth in the preceding paragraph, controller 212 is to cause changes, according to a predetermined function, in cleaning cylinder rotational speed, cleaning cylinder oscillational speed, drum rotation speed, and/or the controlled pressure between the drum 204 and the cleaning cylinder 208. In this manner controller 212 can set cleaning cylinder 208 to operate in an intense cleaning mode, a soft cleaning mode, and/or an abrasive surface preservation mode. In another example, controller 212 may affect cleaning cylinder rotational speed, cleaning cylinder oscillational speed, drum rotation speed, and/or forces exerted as between the drum 204 and the cleaning cylinder 208 according to a predetermined function to set an intensity of cleaning according to a scale, e.g., a scale with 1 being softest cleaning and 100 being the most intense cleaning.

Figure 5:
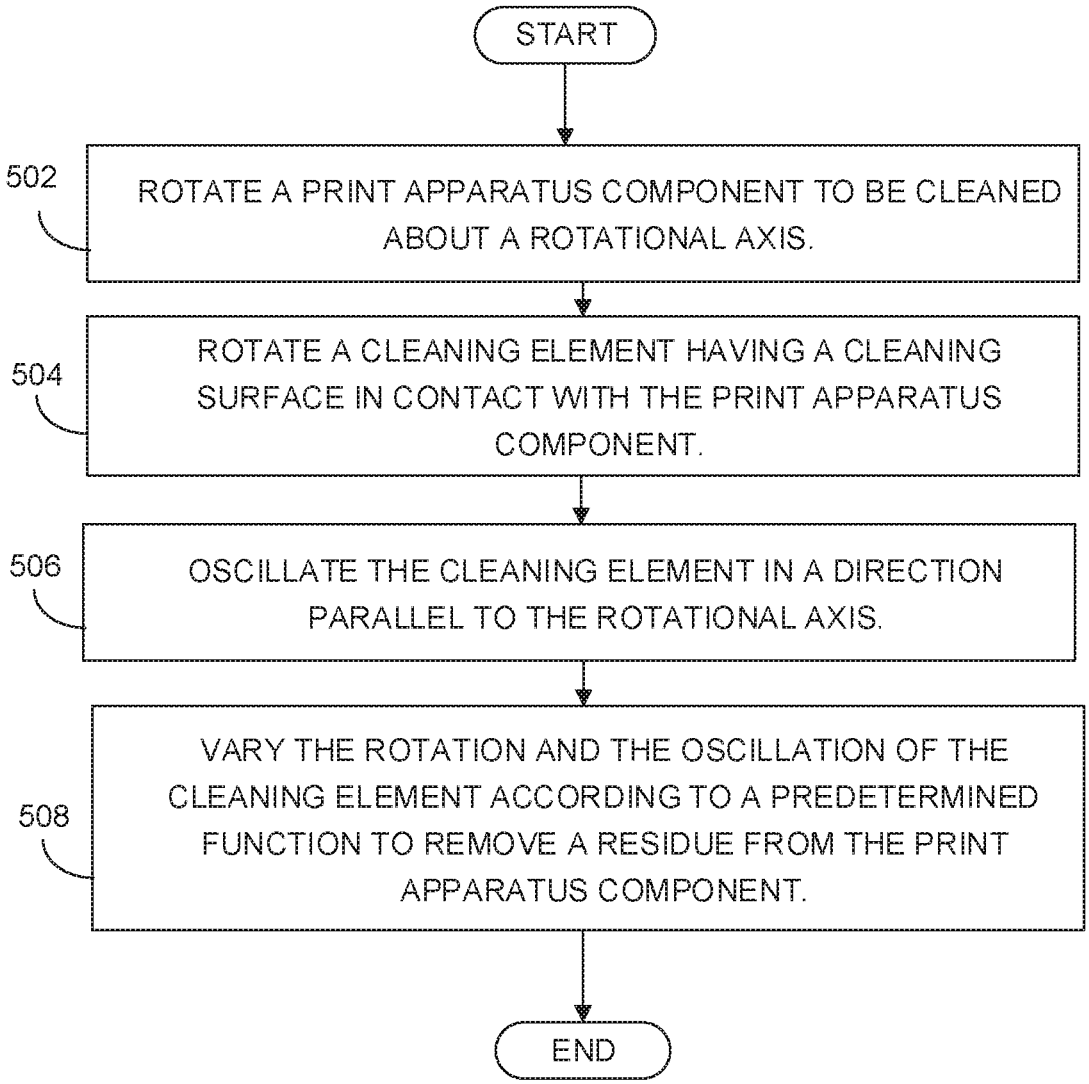
FIG. 5 is a flow diagram depicting an example implementation of a method for cleaning a print apparatus component.

FIG. 5 is a flow diagram of implementation of a method for cleaning a print apparatus component. In an example, a print apparatus component to be cleaned is rotated about a rotational axis (block 502). A cleaning element having a cleaning surface in contact with the print apparatus component is rotated (block 504). The cleaning element is oscillated in a direction parallel to the rotational axis (block 506). The rotation and the oscillation of the cleaning element are varied according to a predetermined function to remove a residue from the print apparatus component (block 508). Referring back to FIGS. 1 and 3, a controller 108 may cause a rotational driver 104 and an oscillational driver 106 to vary the rotation and oscillation of the cleaning element according to the predetermined function. Referring back to FIG. 2, wherein the cleaning element is a cleaning cylinder 208, a controller 212 may cause a cleaning cylinder movement mechanism 210 to vary the rotation and oscillation of the cleaning cylinder 208 according to the predetermined function.

FIGS. 1-5 aid in depicting the architecture, functionality, and operation of various examples. In particular, FIGS. 1-4 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 5 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A method, comprising:

rotating a print apparatus component to be cleaned about a rotational axis;

rotating a cleaning element having a cleaning surface in contact with the print apparatus component;

oscillating the cleaning element in a direction parallel to the rotational axis; and varying the rotation and the oscillation of the cleaning element according to a predetermined function to remove a residue from the print apparatus component, wherein the predetermined function considers an extent of residue or an extent of wear detected at the print apparatus component.

2. The method of claim 1, wherein the print apparatus component is coated with imaging oil.

3. The method of claim 1, wherein the print apparatus component is one from the set of a photoconductor and a developer roller.

4. The method of claim 1, wherein the print apparatus component is a photoconductive cylinder, and the residue is a product of oxidization of a print agent at the print apparatus component.

5. The method of claim 1, wherein the rotational axis is a first rotational axis, and wherein the cleaning element rotates about a second rotational axis parallel to the first rotational axis.

6. The method of claim 1, wherein the predetermined function considers an extent of residue detected at the print apparatus component, and the predetermined function increases oscillation relative to rotation as amount of detected residue increases.

7. The method of claim 6, wherein the extent of residue is detected via analysis of at least one from the a of an image printed by a printing system that includes the print apparatus component, of a measured reflectance at a surface of the photoconductor, and a measurement of electric current between a photoconductor and a developer unit.

8. The method of claim 1, wherein the predetermined function considers an extent of wear detected at the cleaning surface and decreases oscillation relative to rotation as amount of detected wear increases.

9. A system for cleaning a print apparatus component, comprising:

a cleaning element having an abrasive cleaning surface, the cleaning element to contact a print apparatus component that rotates about a first rotational axis;

a rotational driver to cause the cleaning element to rotate about a second rotational axis that is parallel to the first rotational axis;

an oscillational driver to cause the cleaning element to oscillate in an oscillation direction parallel to the first rotational axis; and a controller to cause the rotational driver and the oscillational driver to move the cleaning element to remove a residue from the print apparatus component, wherein the controller is to cause the oscillational driver to decrease engagement relative to rotational driver engagement responsive to receipt of data indicative the cleaning element thickness has degraded to less than a predetermined tolerance.

10. The system of claim 9, wherein the cleaning element includes an abrasive material disposed on at least an outer surface of an absorbent foam substrate, and wherein the cleaning element is positioned such that at least part of the abrasive material engages the print apparatus component.

11. The system of claim 9, wherein the controller is to cause the oscillational driver to increase engagement relative to rotational driver engagement responsive to receipt of an instruction for deep cleaning.

12. A print apparatus comprising:

a drum mounted on a drum axle to rotate along a first rotational axis, wherein the drum includes a photoconductive surface;

a cleaning cylinder mounted on a cylinder axle to rotate along a second rotational axis parallel to the first rotational axis, the cleaning cylinder having an abrasive cleaning surface that is to contact the photoconductive surface;

a cleaning cylinder movement mechanism, the mechanism to cause the cleaning cylinder to rotate about the second rotational axis;

to cause the cleaning cylinder to oscillate in an oscillation direction that is parallel to the first rotational axis, and a controller to vary the oscillation of the cleaning cylinder in the oscillation direction and the rotation of the cleaning cylinder about the second rotational axis responsive to receipt of data indicative of a degree of residue at the photoconductive surface.

13. The print apparatus of claim 12, wherein a rotation of a cleaning element and an oscillation of the cleaning element relative to the rotation of the drum causes the cleaning element to remove residue from the photoconductive surface with a diagonal wiping line.

14. The print apparatus of claim 13, wherein changes in one or more of a set of a rotational speed of the cleaning element, an oscillation speed of the cleaning element, and a rotational speed of the drum are to cause variances in an angle of the diagonal wiping line.

* * * * *